US006513464B1

(12) United States Patent
Busch

(10) Patent No.: US 6,513,464 B1
(45) Date of Patent: Feb. 4, 2003

(54) TWO CYCLE STRATIFIED CHARGE GASOLINE ENGINE

(76) Inventor: Frank Busch, 28401 W. Maple Ave., Wauconda, IL (US) 60084

( * ) Notice: Subject to any disclaimer, the term of this patent is extended or adjusted under 35 U.S.C. 154(b) by 0 days.

(21) Appl. No.: 10/114,789

(22) Filed: Apr. 3, 2002

(51) Int. Cl.[7] ..... F02B 75/02

(52) U.S. Cl. ..... 123/65 VA; 123/65 VC; 123/73 V; 137/855

(58) Field of Search ..... 123/65 V, 65 VA, 123/65 VC, 73 V; 137/855, 512.15

(56) References Cited

U.S. PATENT DOCUMENTS

| | | | |
|---|---|---|---|
| 1,813,258 | A | 4/1931 | Riley |
| 2,022,841 | A | 12/1935 | Bischof |
| 2,197,107 | A | 4/1940 | Kammer |
| 2,362,700 | A | 11/1944 | Kirtland et al. |
| 2,523,599 | A | 9/1950 | Sparmann |
| 2,554,645 | A | 5/1951 | Serste et al. |
| 2,756,731 | A | 7/1956 | Wille |
| 4,305,361 | A | 12/1981 | Perry |
| 4,386,587 | A | 6/1983 | Simko |
| 4,391,234 | A | 7/1983 | Holzeitner |
| 4,445,467 | A | 5/1984 | Westerman et al. |
| 4,481,911 | A | 11/1984 | Sheaffer et al. |
| 4,621,596 | A | 11/1986 | Uchinishi |
| 5,048,472 | A | 9/1991 | Takashima |
| 5,063,887 | A | 11/1991 | Ozawa et al. |
| 5,144,919 | A | 9/1992 | Franz |
| 5,660,152 | A | 8/1997 | Masuda |
| 5,782,214 | A | 7/1998 | Nanami et al. |
| 5,794,605 | A | 8/1998 | Kato |
| 5,870,982 | A | 2/1999 | Strawz |
| 5,899,177 | A | 5/1999 | Binversie et al. |

FOREIGN PATENT DOCUMENTS

| | | |
|---|---|---|
| FR | 817159 | 8/1937 |

OTHER PUBLICATIONS

The High Speed International Combustion Engine, by Harry R. Ricardo, 4th Edition, 1952, reprinted 1962, by Blackie & Son Limited, Glasgow, Scotland; pp. 194–199, describing reflected waves of exhaust gases; pp. 357–359. describing the need for stratification and fuel injection to obtain good fuel economy at reduced loads; and, pp. 360–369, describing the development of an open ended sleeve.

Article entitled: "Is There a Stroker in Your Future?", p. 25, Jul. 1996, "Cycle World".

*Primary Examiner*—Noah P. Kamen
(74) *Attorney, Agent, or Firm*—Thomas Vigil; Welsh & Katz, Ltd.

(57) ABSTRACT

The stratified two cycle engine comprises: a cylinder having an upper end and a lower end, a head at the upper end and fuel and air intake ports at the lower end; at least one spark plug mounted in the head; a sleeve in the cylinder having an upper end and a lower end and the cylinder having exhaust ports at the upper end which are covered and uncovered by the upper end of the sleeve; a piston in the sleeve and connected to a crank shaft; a first exhaust manifold at one side of the cylinder at the upper end thereof adjacent one exhaust port in the cylinder and having first exhaust gas throttle valve means associated therewith; at least a first and a second fuel and air intake manifolds at one side of the cylinder and at the other side of the cylinder in communication with first and second fuel and air intake ports in the cylinder; throttle valve means in each intake manifold; a reed cage assembly in each intake manifold adjacent the associated intake port for injecting a fuel and air mixture into the cylinder; control means for controlling the injection of fuel and air mixture into the cylinder so that fuel and air mixture is injected into the cylinder through only one intake port when the engine is operating from zero to one half full load; and an operating connection between the crank shaft and the sleeve for causing reciprocation of the sleeve relative to movement of the piston to open and close the exhaust ports and the air and fuel intake ports in the cylinder.

15 Claims, 5 Drawing Sheets

TWO CYCLE STRATIFIED CHARGE GASOLINE ENGINE

BACKGROUND OF THE INVENTION

1. Field of the Invention.

The present invention is directed to a two cycle stratified charge gasoline engine, and more particularly, to fuel injection structure and cylinder construction which provides far lower gasoline consumption at zero to one half full load on the engine. This fuel economy is achieved by directing a gas-air mixture into the cylinder in a predetermined path, namely, by directing the gas-air mixture along the top of a piston and then upwardly along one side of the cylinder in a generally L-shaped path. The engine of the present invention and the method of operating same provide a large improvement in part throttle fuel economy which is considered to be the prime virtue of the engine.

It also has several other advantages over contemporary designs, namely:

(1) compact size, with especially short overall length which makes it well suited to transverse engine installation;

(2) very high power output for an engine of its size and weight;

(3) fewer parts which should result in lower manufacturing costs;

(4) low combustion and exhaust temperatures in the normal driving range greatly reducing NOX emissions;

(5) a low pressure fuel injection system using standard, low cost fuel pump and injectors; and, (6) a lubrication system which is standard automotive practice, with optional wet or dry sump.

2. Description of the Related Art.

Heretofore a number of two cycle stratified charge gasoline engines have been proposed and examples of analogous and non-analogous engines are disclosed in the following analogous and non-analogous U.S. patents:

| U.S. Pat. No. | Patentee |
|---|---|
| 1,813,258 | Riley |
| 2,022,841 | Bischof |
| 2,197,107 | Kammer |
| 2,362,700 | Kirkland, et al. |
| 2,532,599 | Sparmann |
| 2,554,645 | Serste et al. |
| 2,756,731 | Wille |
| 4,305,361 | Perry |
| 4,386,587 | Simko |
| 4,391,234 | Holzkeitner |
| 4,445,467 | Westermann et al. |
| 4,481,911 | Sheaffer et al. |
| 4,621,596 | Uchinishi |
| 5,048,472 | Takashima |
| 5,063,887 | Ozawa et al. |
| 5,144,919 | Franz |
| 5,660,152 | Masuda |
| 5,782,214 | Nanami et al. |
| 5,794,605 | Kato |
| 5,970,982 | Strawz |
| 5,899,177 | Binversie et al. |

LITERATURE REFERENCES

THE HIGH SPEED INTERNAL COMBUSTION ENGINE, by Harry R. Ricardo, fourth edition, 1952, reprinted 1962, by Blackie & Son Limited, Glasgow, Scotland:

pages 194–199, describing reflected waves of exhaust gases;

page 357–359, describing the need for stratification and fuel injection to obtain good fuel economy at reduced loads; and, pages 360–369, describing the developement of an open ended sleeve.

Article entitled "IS THERE A STROKER IN YOUR FUTURE?", page 25, July 1996, "CYCLE WORLD".

BRIEF SUMMARY OF THE INVENTION

According to the present invention, there is provided a stratified charge two cycle engine comprising:

a cylinder having an upper and a lower end with a head at the upper end and fuel and air intake ports at the lower end;

at least one spark plug mounted in the head;

a sleeve in the cylinder having an upper end and a lower end;

the cylinder having exhaust ports at the upper end which are covered and uncovered by the upper end of the sleeve;

a piston in the sleeve and connected to a crank shaft;

a first exhaust manifold at one side of the cylinder at the upper end thereof adjacent one exhaust port in the cylinder and having first exhaust gas throttle valve means associated therewith;

at least a first and a second fuel and air intake manifolds at one side of the cylinder and at the other side of the cylinder in communication with first and second fuel and air intake ports in the cylinder;

throttle valve means in each intake manifold;

a reed cage assembly in each intake manifold adjacent the associated intake port for injecting a fuel and air mixture into the cylinder;

control means for controlling the injection of fuel and air mixture into the cylinder so that fuel and air mixture is injected into the cylinder through only one intake port when the engine is operating from zero to one half full load; and an operating connection between the crank shaft and the sleeve for causing reciprocation of the sleeve relative to movement of the piston to open and close the exhaust ports and the air and fuel intake ports in the cylinder.

Also there is provided a method for operating the engine described above comprising the steps of:

first supplying, when the engine is operating at partial load, air to the cylinder after combustion in a cycle of the piston as the piston approaches bottom dead center;

then supplying, when the engine is operating at partial load, fuel under pressure to the reed cage;

supplying throttled air under pressure to the reed cage to cause a reed in the cage to move slightly to aspirate fuel into the flowing air to create a mist-like mixture of fuel and air which is expressed into the cylinder on one side only while pressurized air is entering the cylinder through other air intake ports in the cylinder;

while exhaust gases are exiting the cylinder at the top of the cylinder such that the fuel and air mixture enters the cylinder above the piston travels radially inwardly and then upwardly in a generally L-shaped path toward the cylinder head and along the other side of the cylinder;

closing the exhaust ports with the sleeve with the air and fuel mixture being compressed in the cylinder by the upward movement of the piston; and, causing combustion of the fuel and air mixture in the cylinder.

DETAILED DESCRIPTION OF THE INVENTION

Figure 1:
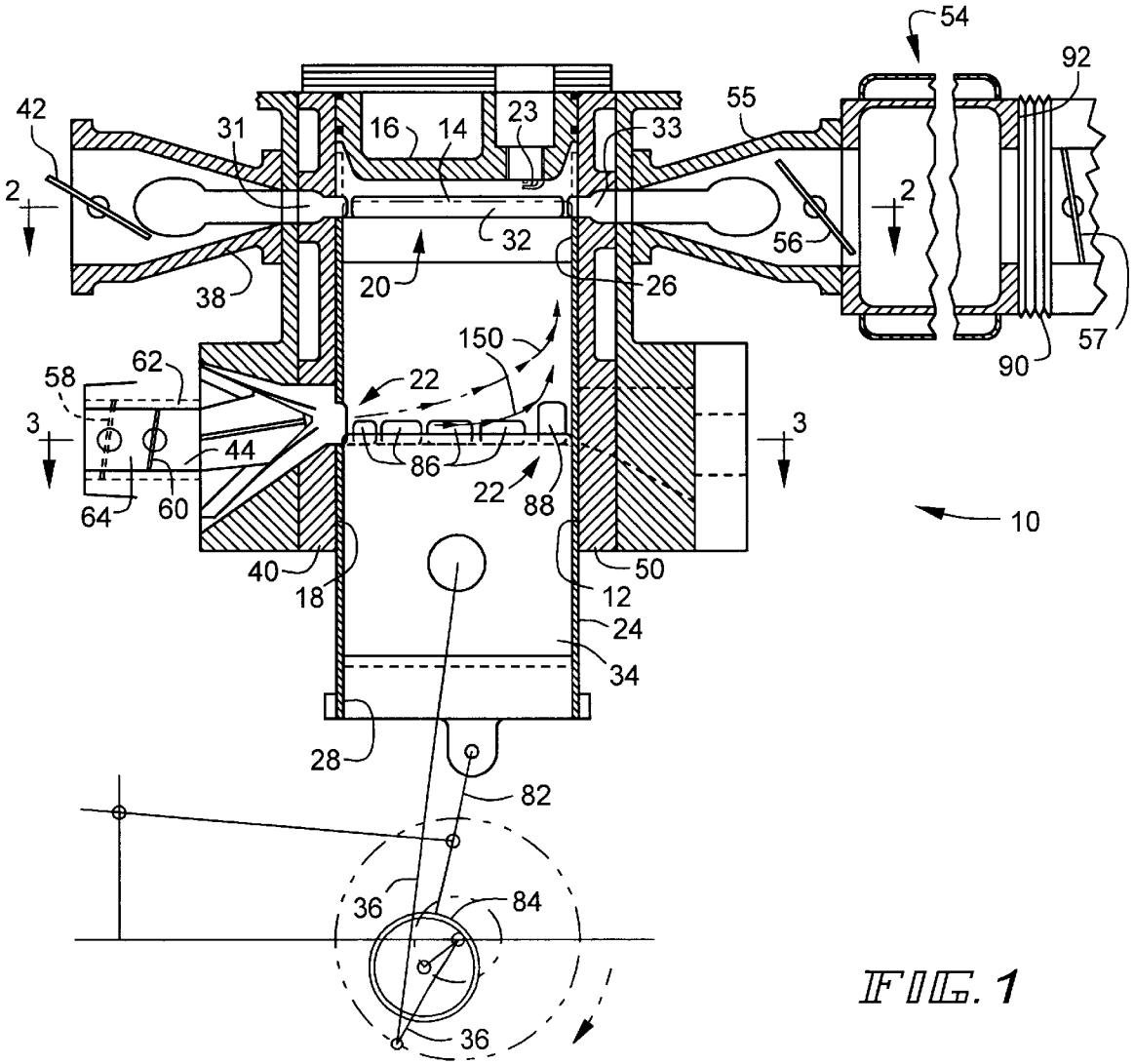
FIG. 1 is a vertical, partially sectional and partially schematic, view of a stratified two cycle engine constructed according to the teachings of the present invention when the engine is operating at less than 50% load.

Referring now to the drawings in greater detail, a stratified two cycle engine 10 comprising a cylinder 12, having an upper end 14 (piston top dead center) on which a head 16 is mounted and a lower end 18 with exhaust ports 20 at the upper end 14 and fuel and air intake ports 22 at the lower end 16 is shown.

At least one spark plug 23 is mounted in the head 16.

A sleeve 24 is mounted in the cylinder 12 and has an upper end 26 and a lower end 28.

The cylinder 12 has exhaust ports 31, 32, 33 and 34 (shown in FIG. 2 only) at the upper end 14 which are covered and uncovered by the upper end 26 of the sleeve 24.

A piston 34 is mounted in the sleeve 24 and is connected to a crank shaft 36.

A first exhaust manifold 38 (FIG's. 1 and 2), in direct communication with exhaust ports 31,32 and 34, is mounted at one side 40 of the cylinder 12 at the upper end 14 thereof adjacent the exhaust port 31 in the cylinder 12 and has a first exhaust gas throttle valve 42 therein in communication with exhaust ports 31, 32 and 34.

First and second air intake manifolds 44 and 46 (FIG. 3) are located respectively at the one side 40 of the cylinder 12 and at the other side 50 of the cylinder 12 (FIG. 1) and are in communication with first, second and third fuel and air intake ports 51, 52 and 53 (FIG. 3) in the cylinder 12.

An exhaust gas reservoir 54 is provided at the other or opposite side 50 of the cylinder at the upper end 14 of the cylinder 12. A second exhaust manifold 55 is in communication with the exhaust ports 32, 33 and 34 leading to the exhaust gas reservoir 54 and has an exhaust gas throttle valve 56 therein and an outlet throttle valve 57.

In the air intake manifold 44, two throttle valves 58 for intake air and one throttle valve 60 for air to be mixed with fuel, are positioned in air intake channels 62 and 64.

An individual reed cage assembly 66 including a reed cage 68 for each fuel and air intake port 51, 52 and 53, are mounted in the intake manifolds 44 and 46 adjacent each one of three fuel and air intake ports 51–53 in the cylinder 12 for injecting a fuel and air mixture into the cylinder 12.

A control circuit 80 (FIG. 9) is provided for controlling the injection of fuel and air mixture into the cylinder 12 so that fuel and air mixture is injected into the cylinder through only one intake port 51 when the engine is operating from zero to one half full load.

Finally an operating mechanism 82, 84 is provided between the crank shaft 36 and the sleeve 24 for causing reciprocation of the sleeve relative to movement of the piston 34 to open and close the exhaust ports 31–34 and the air and fuel intake ports 51–53 in the cylinder 12.

Figure 3:
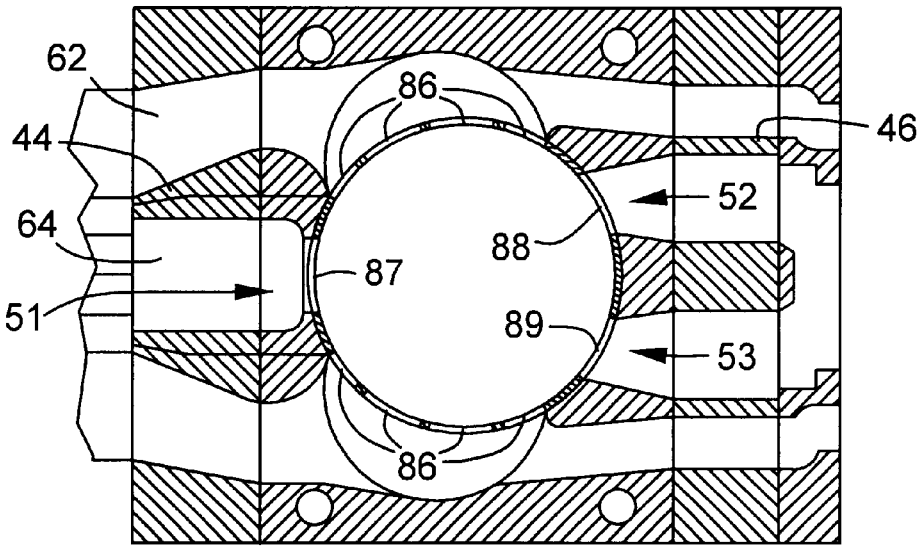
FIG. 3 is a sectional view through an air intake manifold at the lower end of the cylinder shown in FIG. 1.

As shown in FIGS. 1 and 3, the sleeve 24 has a plurality of air intake ports 86 through the sleeve 24 around the mid area of sleeve 24. At selected locations around the sleeve and between the ports 24, three air and fuel and air intake ports 87, 88 and 89 (FIG. 3) are provided and located such that the ports 87–89 are moved into alignment with the ports 51–53 when the sleeve 24 is reciprocated. The height of each port 87–89 is greater than the adjacent air intake ports 86 to insure full injection of fuel 5 and air mixtures into the cylinder 12. Also, since these ports 87–89 are still open after exhaust ports 31–34 are closed, some supercharging can take place from the increase in air pressure from the additional air admitted into the cylinder 12 at high loads. Further, the axis of the ports 87–89 extending into the cylinder 12 can intersect and form a Y configuration.

Figure 2:
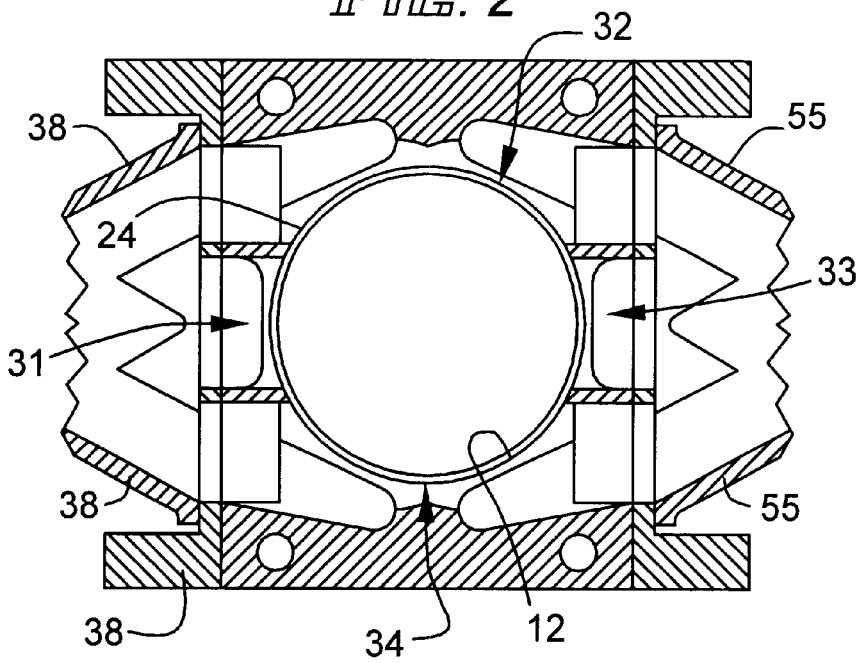
FIG. 2 is a sectional view through an exhaust manifold at the top of a cylinder shown in FIG. 1 and is taken along line 2—2 of FIG. 1.

The exhaust gas reservoir 54 is fed partially from exhaust ports 31, 32 and 33 as is the exhaust manifold 38, as best shown in FIG. 2.

The air inlet ports 51–53 and mating inlet ports 87–89 and their Y configuration is best shown in FIG. 3.

Figure 4:
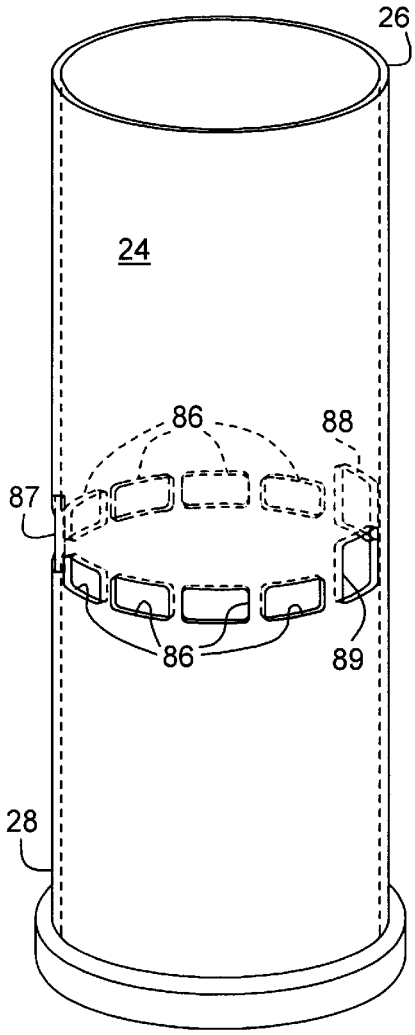
FIG. 4 is a perspective view of a sleeve in the engine shown in FIG. 1.

A perspective view of the sleeve 24 is shown in FIG. 4.

Figure 5:
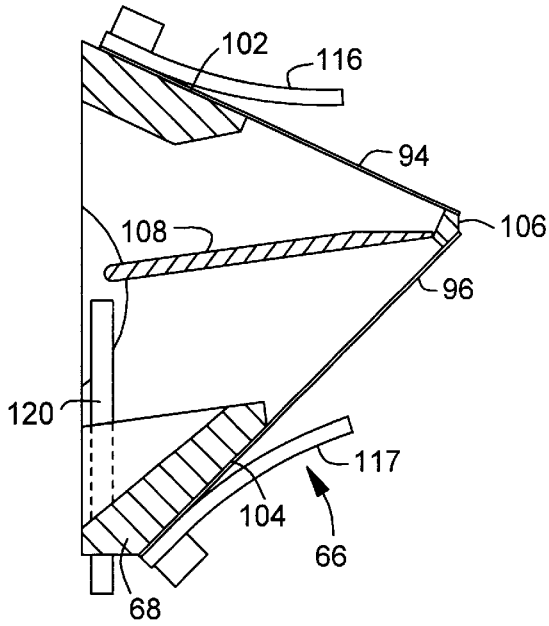
FIG. 5 is a sectional view through a reed cage assembly which is mounted adjacent each fuel and air intake port in the cylinder of the engine and shows two reeds of the assembly in a closed condition.
Figure 6:
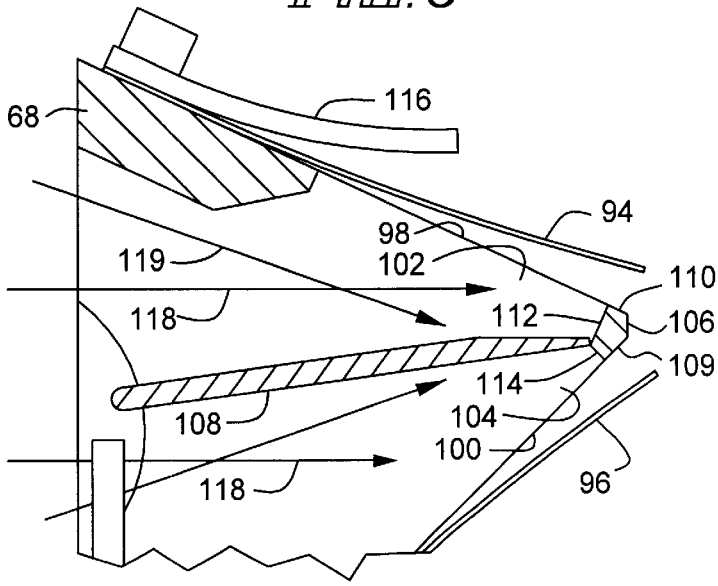
FIG. 6 is a slightly enlarged sectional view of the reed cage assembly shown in FIG. 5 and shows the two reeds in an open position caused by the flow of pressurized fuel and air into the reed cage assembly.

A reed cage assembly 66 is shown in FIGS. 5 and 6 and includes the cage 68 and reeds 94 and 96 mounted on sides or seats 98 and 100 of the cage and over respective openings 102 and 104 in the sides of the cage 68. The cage 68 includes a cage nose tip 106 and a baffle wall 108 extends in the cage to the nose tip 106. A land 109, 110 extends across and on each side of the nose tip 106 (into the plane of FIG. 6) and has a width between 0.050 and 0.120 inch. Steps or abutments 112 and 114 are provided at the end of the baffle wall 108 at the nose tip 106 for deflecting fuel into the air flow. Each step extends approximately 90 degrees to an adjacent reed 94 or 96. A reed stop plate 116 or 117 is provided for limiting reed deflection. Air flow is shown by arrow 118 and fuel flow by arrow 119. The fuel injected hits and flows along the baffle wall 108 to the step 112 or 114 where it is deflected toward the reed 94 or 96 and aspirated into the air flow 118.

As shown in FIG. 6, an aspirating tube or standpipe 120 can be provided for aspirating fuel that condenses and flows to the bottom side of the reed cage 68 mounting recess.

Figure 8:
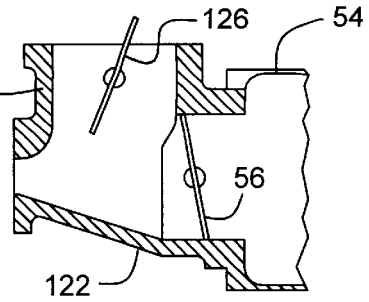
FIG. 8 is a sectional view through a modified portion or alternative form of the exhaust manifold connected between the cylinder and the exhaust gas reservoir.

In FIG. 8 is illustrated a modified manifold 122 to the exhaust gas reservoir 54. Here, a bypass 124 to the main exhaust system is provided for quickly exhausting the exhaust gas by opening the butterfly throttle valve 126 in the bypass 124.

Figure 9:
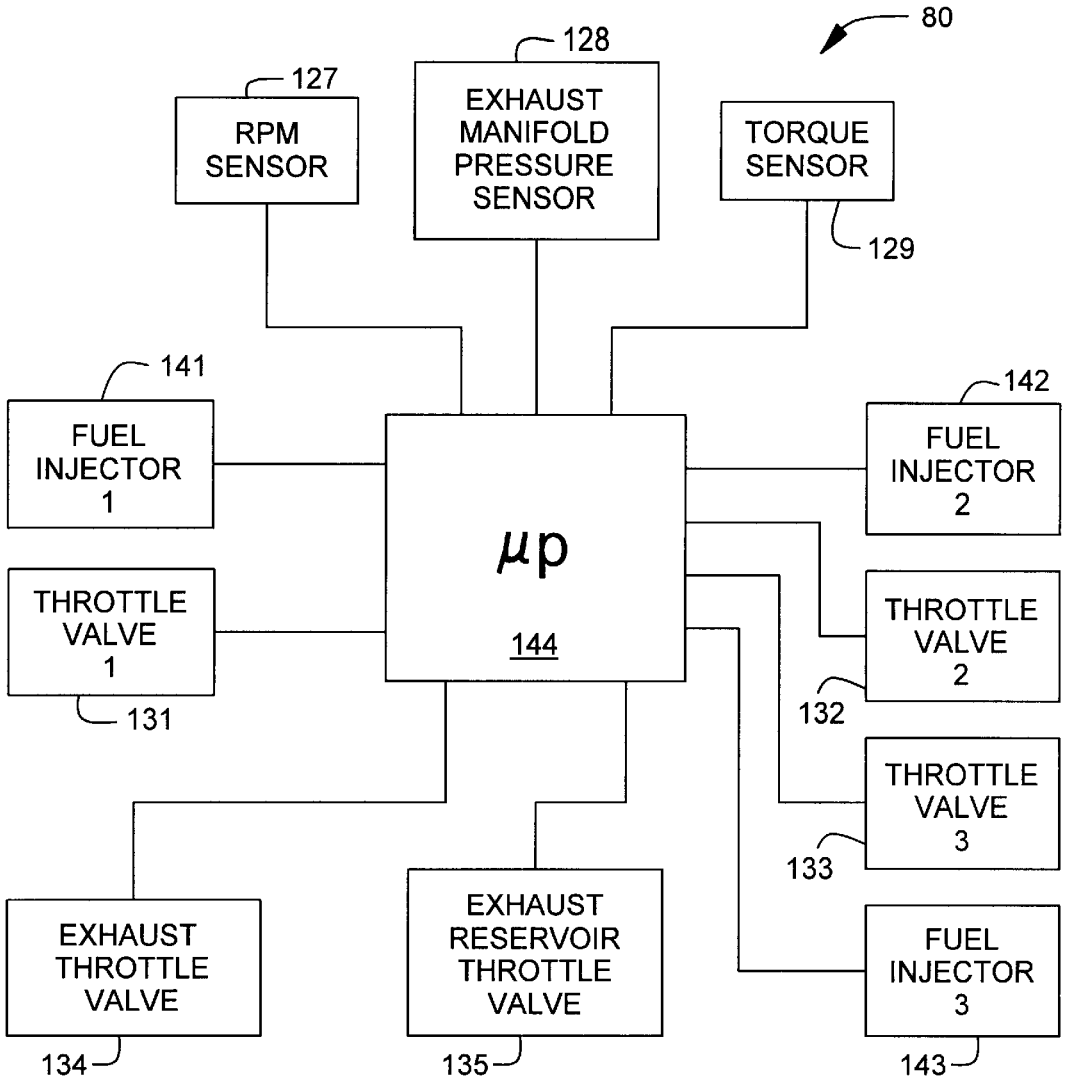
FIG. 9 is a block schematic circuit diagram of a control circuit for controlling operation of the engine shown in FIG. 1.

The control circuit 80 is shown in FIG. 9 and includes Rpm senor 127, Exhaust Manifold Pressure sensor 128 and Torque sensor 129 and five valve controls 131–135 and three fuel injector controls 141–143, all connected to a microprocessor 144.

FIG. 1 illustrates by arrows 150, the flow of the fuel and air mixture at a partial load, when fuel and air is only injected into the cylinder 12, in a generally L shaped path, i.e., with the fuel and air mixture entering the cylinder 12 above the piston 34 and traveling radially inwardly and then upwardly in a generally L-shaped path toward the cylinder head 16 and along the other side 50 of the cylinder 12, displacing the residual exhaust gases toward the left side of the cylinder 12 and the left exhaust port.

Figure 7:
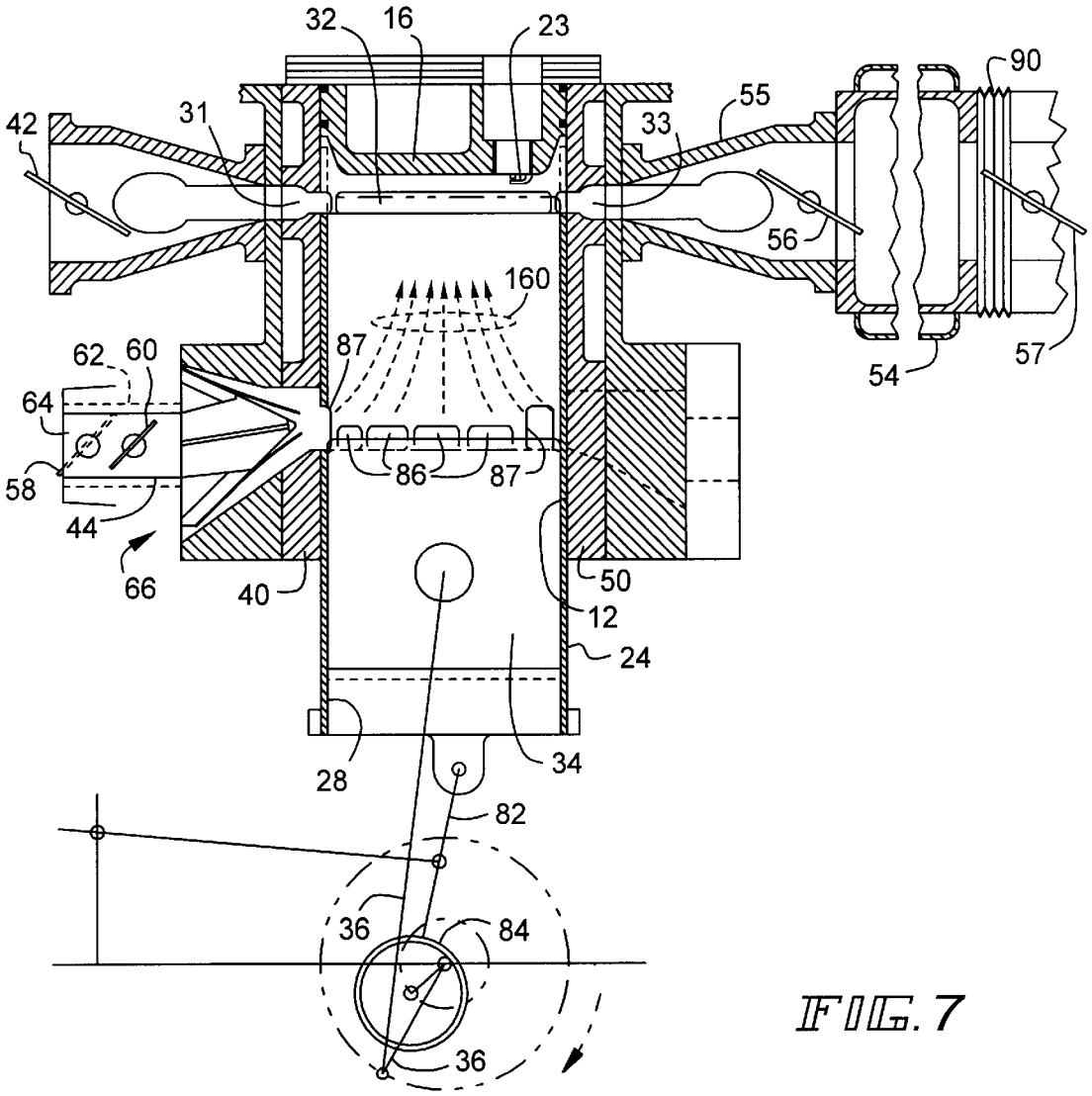
FIG. 7 is a is a vertical, partially sectional and partially schematic, view of a stratified two cycle engine, similar to the view shown in FIG. 1 and shows the engine when the engine is operating at more than 50% load.

FIG. 7 illustrates by arrows 160, the flow of the fuel and air mixture at over 50% load when fuel and air is injected through all three (3) air intake ports 51, 87 and 52, 88 and 53, 89 into the cylinder 12.

Standard automotive fuel injectors (not shown) are mounted in the reed cage assemblies 66 and operate at 20 to 40 pounds of pressure. The principal advantages of fuel injection in the engine 10 of the present invention is the ability to time the introduction of the fuel to the cylinder 12 and by varying the pulse width, the quantity of injected fuel. By delaying fuel-air injection until air flow into the cylinder is well established, exhaust products that would dilute the flammable mixture can be displaced. The possibility of mixture loss through the exhaust ports 30–34 is thus eliminated. Also, fuel injection can be ended before airflow into the cylinder 12 ceases, ensuring that all fuel reaches its intended destination.

Direct injection into the cylinder 12 at the usual 30 to 40 pound pressure would result in fuel precipitation on the opposite side 50 of cylinder. To avoid this and to control the entry speed of the fuel, the injector is aimed at an angle to the fixed baffle wall 108 in the reed cage 68 opposite each reed 94 and 96. Depending on the angle of impact of the fuel with this baffle wall 106, much of its velocity is canceled. Whether the spray pattern is cone or pencil shaped, the fuel moves as a film to a reed cage nose tip 106. At the reed cage tip 106, where the reed closes the air flow apertures or openings 102 and 104, a step or abutment 112 or 114, approximately 0.03 to 0.10 inch high is provided on each side of the reed cage tip 106. After the reed 94 or 96 has opened with the passage of air, the arriving fuel is aspirated into the air stream in a finely atomized mixture. Thus, the entry speed of the fuel to the cylinder 12 is determined by the throttle valve 60 controlling the air pressure, reed spring rate, and the acceleration imparted to the fuel as it crosses the width of the land at the reed cage tip.

Since, at any given load, total scavenge air flow is the sum of reed fuel-air flow and main air flow, reed air flow can be adjusted to obtain the desired cylinder penetration and the balance of the required air supplied through the main air intake ports. The fan-shaped fuel spray pattern leaving the reed cage assembly 66 can be altered by the use of a straight, curved or specially shaped step or abutment 112 or 114 at the reed cage tip 106—a straight step will tend to disperse the fuel over a wider arc than a radius step-by controlling this contour fuel concentration within the fan-shaped spray can be varied at will.

The width of the lands 109, 110 at the reed cage tip 108 influences the velocity acquired by the fuel as it passes through the reed-read cage aperture 102 or 104—the wider the land 109 or 110 the greater the acceleration imparted to the fuel by the air.

If desired, channels can be machined into the faces of the seats 98,100 of the reed cage 68 to create a recess that snugly confines the sides of the reeds 94, 96 in the respective channels, and air flow from the sides of each reed is prevented. This ensures maximum atomization of the fuel-air pattern entering the cylinder and control of its shape.

With any given reed cage configuration, it is possible to alter the angle of horizontal entry of the fuel air to the cylinder 12 by altering the length of the reeds 94, 96. This is especially true where pairs of reeds 94, 96 are employed by terminating one reed 94 short of the reed cage tip and/or extending the other reed 96 beyond the reed cage tip 108 it is possible to deflect the issuing stream toward the side having the shorter reed 94.

In operation, fuel condensation takes place in the recess occupied by the reed cage 68. This condensation will accumulate and eventually enter the cylinder in gulps. To prevent this, the small standpipe or tube 120 open at both top and bottom ends is installed in the reed cage 68. The bottom end of the standpipe 120 is positioned near the bottom of the reed cage 68 recess and its upper end near the center of the air flow through the cage 68. Since the reeds 94, 96 prevent any back flow of cylinder gases into the intake manifold 44, the sleeve intake port 87 adjacent to the reeds 94, 96 can be allowed to open before cylinder lowdown is complete. The pressure differential between the cylinder 12 and the interior of the reed cage 68 during lowdown forces any collected fuel condensation through the standpipe 120 into the reed cage interior where it is delivered to the cylinder during the following injection period. The orifice at the upper end of the standpipe can be as small as 0.030. Thus, the effect on total air flow is negligible.

The current engine configuration uses eight injectors, one at each left reed assembly and two injectors at each reed assembly on the right side. The right side injectors can be activated singly or together. Using both injectors permits a shorter injection period. Since injector pulse width is limited to a period shorter than transfer port opening duration—about 110° maximum—the use of two injectors with smaller flow rates provides greater precision of fuel delivery while satisfying maximum flow requirements.

The use of a single injector at the lower end of the power range permits a longer pulse width of the injector. The longer pulse width, persisting through the major portion of air flow, yields a more homogeneous fuel air mixture, with resulting better fuel economy and lower emissions.

The right side injectors (side 40) supply all fuel from idle to about 40 to 50% of maximum torque. At higher loads air flow through the left reeds (side 50) is increased, fuel is injected through them and the left and right exhaust valves 42, 56 and 57 are opened.

Engine Specifications

Type: two cylinder, two stroke, sleeve valve, liquid cooled, balance shafts in crankcase to counter primary rocking couple.

Nominal Comp. Ratio—10.33 to 11 Trapped Ratio—8.54–1 85 mm bore (3.346) ×88.9 mm (3.50 in.) stroke; 0.1008.92 cc 61.66 cu. in.

Dry sump oil system with 30 to 40 lbs. pressure to main bearings, connecting rod big ends and balance shafts.

Needle bearings in con rod small ends.

Scavenge oil pump with remote oil tank.

Oil cooling by coolant heat exchanger.

Scavenge air is supplied by Eaton Model 45 roots blower with variable speed belt drive.

Ignition system is conventional, with either two or three spark plugs per cylinder.

Throttle controlled exhaust flow is provided at both sides of each cylinder.

Individual throttles control air flow through the right side reeds, the left side reeds, right side air ports and left side air ports.

Settings of exhaust and air throttles are adjusted to provide optimum flow patterns for all operating conditions.

Fuel Efficiency and Preignition in Two Cycle Engines

Attempts to obtain better fuel economy with a conventional two cycle engine by the use of lean fuel air ratios and contemporary compression ratios are virtually certain to result in pre-ignition. The pre-ignition is the product of high temperature residual exhaust gases, the heat of compression and local hot spots such as the spark plugs. Critical conditions occur at part throttle, i.e., at about 30 to 60% load. Below 30% load the volume and temperature of the residual gases are too low to produce pre-ignition. Above 60% the incoming mixture displaces enough exhaust gas to reduce the temperature below the pre-ignition point.

If lean mixtures are used to reduce flame temperatures and slow the combustion rate, mixing of the fuel charge with exhaust products makes ignition uncertain and misfiring becomes a problem. Compression ratio is limited to ratios below those of four stroke engines, not because of detonation, but because the higher temperatures and pressures trigger pre-ignition.

It is believed that a sleeve valve two cycle engine, with its exhaust and intake ports at opposite ends of the cylinder, provides an excellent starting point for an effort to realize the potential virtues of two cycle engines.

The control of the ascending column of air—its volume and bias toward the left center or right side of the cylinder—is obtained by the relative opening of the left and right throttle valves.

When effective stratification is accomplished, very lean mixtures can be burned, their combustion aided by the overall high cylinder temperatures. Auto ignition can be employed, with the ignition point and burning rate controlled by the amount of excess air. Efficient stratification is essential, since the compression ratio that can be employed and the resulting fuel economy are dependent on control of the remaining volume and segregation of the residual exhaust products.

To accomplish stratification at part load, the method of the present invention provides the "L" shaped scavenge pattern, with the fuel air mixture entering the bottom of the cylinder on one side and traveling up the opposite cylinder wall. Exhaust gases leave the cylinder through ports at the top end of the cylinder on the same side as the entering mixture. The "L" shaped travel path minimizes the risk of loss of mixture through the exhaust ports.

Having the mixture flow parallel to the piston head and along opposite cylinder wall also favors attachment of the flow to these surfaces, minimizing mixing with the residual exhaust gases.

Although flow of both exhaust and scavenge gases is possible throughout the 360° circumference of the cylinder, throttles at both sets of ports are employed to control the desired flow pattern throughout the entire range of speed and load. In this engine, the exhaust flow to atmosphere on one side 50 of the cylinder 12 is completely closed at part load. The left side scavenge ports play a minor role in part throttle operation, with a small flow (which opposes flow of mixture from the center scavenge port on the right side) used to prevent centrifuging of fuel particles onto the left cylinder wall. This flow also helps to control the size and velocity of the column of mixture ascending the cylinder wall. Adding air from the left side ports increases the area while decreasing its speed.

With increasing torque level, a region is entered where auto ignition can no longer be controlled by lean mixtures. Additional air will cause misfiring. The increasing temperature and volume of residual exhaust gases turn auto ignition into pre-ignition. To pass through this phase into the spark ignition regime, counterflow from the air ports 46 on the side 50 of the cylinder 12, is employed. This flow, depending on the relative openings of the left and right throttle valves, will shift the ascending air column toward the side 40 of the cylinder 12 as indicated by arrows 150, displacing additional hot exhaust gases through the exhaust ports 31, 32 and 34. This reduces cylinder temperatures enough to suppress pre-ignition.

Since the "L" shaped mixture flow pattern is the most efficient in terms of removal of exhaust gases and prevention of mixture loss through the exhaust port, its use is maintained until the combination of load and speed require an increase in active port area. At this time, the left exhaust ports are opened by their controlling throttle valves. Fuel flow from the right reed assemblies is reduced and fuel flow and increased air flow from is started from the left reed assemblies. At maximum power all ports are operating at full capacity.

Scavenge Air Supply-Pumping Losses

The ideal scavenge air pump would be of positive displacement with zero internal leakage and internal compression. It would have a variable speed drive, matching air flow to engine requirements. Unfortunately, such a pump is not available and internal leakage at engine cranking speeds makes the use of an auxiliary source of air at 0.5 to 1 p.s.i. necessary. A variable speed drive to a conventional roots blower presently provides scavenge air with an electric centrifugal fan used to aid starting.

Idle, Low Load and No Load Operation

Conventional two stroke engines can afford the use of over rich mixtures and a retarded spark to obtain smooth operation under no load and low load conditions but when maximum fuel economy is absolutely necessary this extravagance cannot be tolerated.

With stratified charge operation of the present engine the situation is much improved but a threshold is reached where the quantity of fresh charge is too small to maintain consistent combustion. This boundary is reached at about 3 to 4 foot pounds of torque, when fuel mixture delivery to each cylinder falls to about 3 cu.in.

Below this limit, one of the cylinders is deactivated by switching off its injector. This doubles the load on the remaining cylinder and provides smooth economical operation down to a 700 rpm idle.

If desired, pumping losses can be reduced by closing the air or exhaust throttles of the idle cylinder diverting its flow to the active cylinder. This also helps to maintain exhaust temperatures which aids catalytic conversion.

Also, it will be understood, that to prevent pre-ignition. the timing of the spark plug ignition is adjusted as the engine load varies and the engine operation moves between auto-ignition and normal ignition.

Set forth in TABLE 1 below are measurements made at different loads on a prototype of the engine 10 of the present invention.

TABLE 1

| Run # | 1 | 2 | 3 | 4 |
|---|---|---|---|---|
| TIME | :30 | :41 | :51 | :71 |
| OIL PRESSURE | 34# | 33# | 32# | 32# |
| OIL TEMP. | 169 F. | 180 F. | 187 F. | 190 F. |
| WATER TEMP. | 195 F. | 195 F. | 198 F. | 200 F. |
| EXH. TEMP. | 545 | 670 | 790 | 905 |
| MAN. PRESS. | .76# | .75# | .62# | 1.10# |
| RT. REEDS | 30(degrees) | 35 | 40 | 30 |
| RT. AIR | 11(degrees) | 13 | 17 | 13 |
| LEFT REEDS | 5(degrees) | 5 | 10 | 10 |
| LEFT AIR | 0(degrees) | 10 | 20 | 17 |
| LEFT CTR. AIR | 0(degrees) | 0 | 0 | 0 |
| LEFT EXH. | 20(degrees) | 20 | 20 | 20 |
| RT. EXH. | 20(degrees) | 28 | 33 | 45 |
| ING. TMG./AUTO | 20(degrees) | 20 | 20 | 26/K |
| KNOCK IND. | 0 | 0 | 0 | 1–3 |
| R.P.M. | 1548 | 1593 | 1587 | 1590 |
| TORQUE(19.1") | 6.2# | 10.55# | 15.1# | 21.25# |
| C.F.M. | 10 | 12.8 | 15 | 21.6 |
| FLOW METER | 2.3 | 3 | 3.6 | 4.6 |
| HC PPM | 244 | 232 | 208 | 481 |
| CO2 (%) | 7.37 | 7.75 | 8.22 | 7.33 |
| FUEL #/HR. | 1.78 | 2.83 | 3.62 | 5 |
| HORSEPOWER | 2.976 | 5.093 | 7.262 | 10.24 |
| FUEL #/HP/HR. | 0.598 | 0.556 | 0.498 | 0.488 |

From the foregoing description it will be apparent the engine of the present invention and the method for operating same have a number of advantages, some of which have been described above (increased fuel economy at partial loads) and others of which are inherent in the engine of the present invention.

Also, it will be understood that modifications can be made to the engine and method of the invention without departing from the teachings of the invention.

Accordingly, the scope of the invention is only to be limited as necessitated by the accompanying claims.

I claim:

1. A stratified charge two cycle engine comprising:

a cylinder having an upper end and a lower end with a head at said upper end and fuel and air intake ports at said lower end;

at least one spark plug mounted in said head;

a sleeve in said cylinder having an upper end and a lower end;

said cylinder having exhaust ports at said upper end which are covered and uncovered by the upper end of said sleeve;

a piston in said sleeve and connected to a crank shaft;

a first exhaust manifold at one side of said cylinder at said upper end thereof adjacent one of said exhaust ports in said cylinder and having first exhaust gas throttle valve means associated therewith;

at least a first and a second fuel and air intake manifolds at one side of said cylinder and at said other side of said cylinder in communication with first and second fuel and air intake ports in said cylinder;

throttle valve means in each intake manifold;

a reed cage assembly in each intake manifold adjacent the associated intake port for injecting a fuel and air mixture into said cylinder;

control means for controlling the injection of fuel and air mixture into said cylinder so that fuel and air mixture is injected into said cylinder through only one intake port when the engine is operating from zero to one half full load; and an operating connection between said crank shaft and said sleeve for causing reciprocation of said sleeve relative to movement of said piston to open and close said exhaust ports and said air and fuel intake ports in said cylinder.

2. The engine of claim 1 further including:

an exhaust gas reservoir at the other or opposite side of said cylinder at said upper end of said cylinder;

a second exhaust manifold in communication with said exhaust gas reservoir and having second exhaust gas throttle means associated therewith.

3. The engine of claim 1 further including: a third fuel and air intake and a third fuel and air intake port in said cylinder.

4. The engine of claim 3 wherein said inlet ports each have an axis extending into said cylinder, the axes intersecting each other in a Y configuration with the first fuel and air intake port being at the bottom of the Y.

5. The engine of claim 1 wherein said sleeve has a plurality of air intake ports in a lower portion of said sleeve in position to be moved into alignment with air intake ports in said cylinder.

6. The engine of claim 5 including a fuel and air intake port in said sleeve.

7. The engine of claim 6 wherein said fuel and air intake port in said sleeve has a height in said sleeve which is greater than the height of adjacent air intake ports so as not to provide an obstruction to the injection of the fuel and air mixture into said cylinder.

8. The engine of claim 1 wherein said reed cage has at least one reed mounted on said cage over an opening in said cage, said cage has an internal baffle lying in a plane which is at an angle to a plane containing said reed and said cage has an abutment which is located at the end said baffle and which extends to said reed.

9. The engine of claim 8 wherein said reed cage has a second reed mounted on said cage over a second opening in said cage located opposite said first named opening, said cage has a second abutment which is located at the end said baffle and which extends to said second reed.

10. The engine of claim 8 wherein said abutment extends at an angle of approximately 90 degrees to said reed.

11. A method for operating a stratified charge two cycle engine of the type comprising:

a cylinder having an upper and a lower end with a head at said upper end and fuel and air intake ports at said lower end;

at least one spark plug mounted in said head;

a sleeve in said cylinder having an upper end and a lower end;

said cylinder having exhaust ports at said upper end which are covered and uncovered by an upper end of said sleeve;

a piston in said sleeve and connected to a crank shaft;

a first exhaust manifold at one side of said cylinder at said upper end thereof opposite said exhaust ports in said cylinder and having first exhaust gas throttle valve means associated therewith;

at least a first and a second fuel and air intake manifolds at one side of said cylinder and at said other side of said cylinder in communication with first and second fuel and air intake ports in said cylinder;

throttle valve means in each intake manifold;

a reed cage assembly in each intake manifold adjacent the associated intake port for injecting a fuel and air mixture into said cylinder;

control means for controlling the injection of fuel and air mixture into said cylinder so that fuel and air mixture is injected into said cylinder through only one intake port when the engine is operating from zero to one half full load; and an operating connection between said crank shaft and said sleeve for causing reciprocation of said sleeve relative to movement of said piston to open and close said exhaust ports and said air and fuel intake ports in said cylinder, the method comprising the steps of:

first supplying, when the engine is operating at partial load, air to the cylinder after combustion in a cycle of the piston;

then, supplying, also when the engine is operating at partial load, fuel under pressure to only one of said reed cages;

also supplying throttled air under pressure to said one reed cage to cause a reed in the cage to move slightly to aspirate fuel into the flowing air to create a mist-like mixture of fuel and air which is expressed into said cylinder on one side only while pressurized air is entering the cylinder through other air intake ports in said cylinder, while exhaust gases are exiting said cylinder at the top of said cylinder such that the fuel and air mixture enters said cylinder above the piston travels radially inwardly and then upwardly in a generally L-shaped path toward the cylinder head and along the other side of the cylinder;

closing the exhaust ports with the sleeve; and, causing combustion of the fuel and air mixture in the cylinder.

12. The method of claim 11 for use with an engine which further includes an exhaust gas reservoir at the other or opposite side of said cylinder at said upper end of said cylinder; and a second exhaust manifold in communication with said exhaust gas reservoir and having second exhaust gas throttle means associated therewith; said method including the further step of allowing some of said exhaust gases to flow into said reservoir and then back out of said reservoir thereby to assist in drawing fuel and air mixture upwardly along said opposite side of said cylinder and opposing the reflected wave from partially open throttle valve 42.

13. The method of claim 11 including the step of introducing fuel and air mixture into said cylinder through both air and fuel intake ports when the engine is operating at more than one half load.

14. The method of claim 11 for use with an engine which further includes a third fuel and air intake and a third fuel and air intake port in said cylinder, said method including the step of introducing fuel and air mixture into said cylinder through all three air and fuel intake ports when the engine is operating at more than one half load.

15. In a two cycle stratified charge combustion engine comprising a cylinder block having a cylinder therein, a sleeve in said cylinder having air intake ports and at least one fuel and air intake port in a mid area of said sleeve, said cylinder block having exhaust ports communicating with said cylinder in an upper area of said cylinder, an air intake manifold in a lower area of said cylinder for supplying intake air to said cylinder, said cylinder block having at least one fuel and air intake port opening into said cylinder, the improvement residing in a reed cage assembly positioned adjacent said fuel and air intake port in said cylinder block comprising a cage body having a flat side with an opening through said flat side, said cage body having an interior space, a baffle wall in said interior space in said cage body in a plane spaced from said opening and extending to a cage tip and to a step or abutment adjacent said tip between said baffle wall and said flat surface to cause fuel flowing along said baffle wall to said tip to be diverted outwardly toward said reed on said flat surface.

* * * * *